United States Patent [19]

Aoki et al.

[11] 4,082,936

[45] Apr. 4, 1978

[54] DEVICE AND METHOD FOR HEATING DIE

[75] Inventors: Sethuo Aoki, Noda; Yoshiaki Sogo, Kawasaki, both of Japan

[73] Assignee: Fuji Electric Co., Ltd., Kawasaki, Japan

[21] Appl. No.: 698,637

[22] Filed: Jun. 22, 1976

[30] Foreign Application Priority Data

Jun. 24, 1975 Japan ..... 50-77883

[51] Int. Cl.[2] ..... H05B 9/02

[52] U.S. Cl. ..... 219/10.41; 219/10.57; 219/10.73; 219/10.79

[58] Field of Search ..... 219/10.57, 10.41, 6.5, 219/10.67, 10.73, 10.79

[56] References Cited

U.S. PATENT DOCUMENTS

| | | | |
|---|---|---|---|
| 1,748,465 | 2/1930 | Summey | 219/10.57 |
| 2,226,446 | 12/1940 | Smith et al. | 219/10.41 |
| 3,394,007 | 7/1968 | Campbell | 219/10.79 |
| 3,489,875 | 1/1970 | Ross | 219/10.79 |
| 3,547,715 | 12/1970 | Rossander | 219/10.41 |
| 3,965,321 | 6/1976 | Brinkmann et al. | 219/10.57 |

OTHER PUBLICATIONS

IBM Tech Disc. Bulletin, "Load Coil for RF Coupling", v. 11, No. 7, 12/68.

*Primary Examiner*—Bruce A. Reynolds
*Attorney, Agent, or Firm*—Sughrue, Rothwell, Mion, Zinn and Macpeak

[57] ABSTRACT

A device and a method are disclosed for heating a die by induction heating. The die is positioned in a rectangular bobbin so that the direction of the center axis of the die is perpendicular to the direction of an alternating magnetic field produced by an induction-heating coil wound on the bobbin. This eliminates substantially the large temperature difference between the central portion and peripheral portion of the die. Additionally the die may be rotated within the bobbin, or yokes may be provided to increase the uniformity of the magnetic flux distribution over the die.

8 Claims, 7 Drawing Figures

FIG 1
PRIOR ART
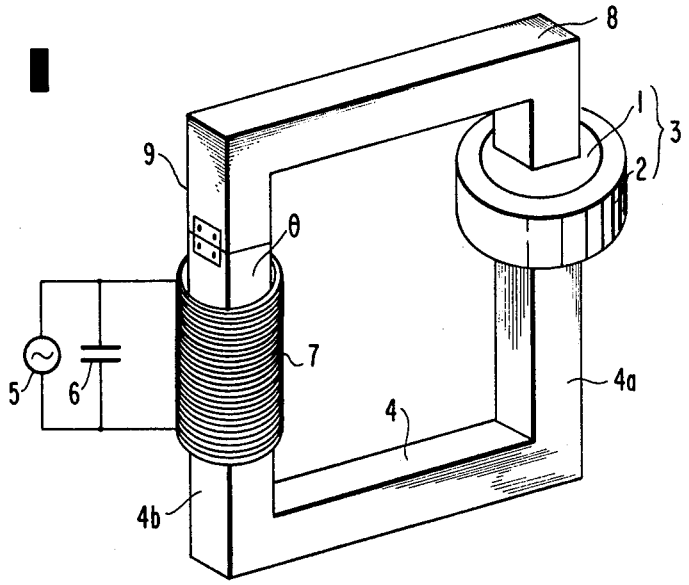
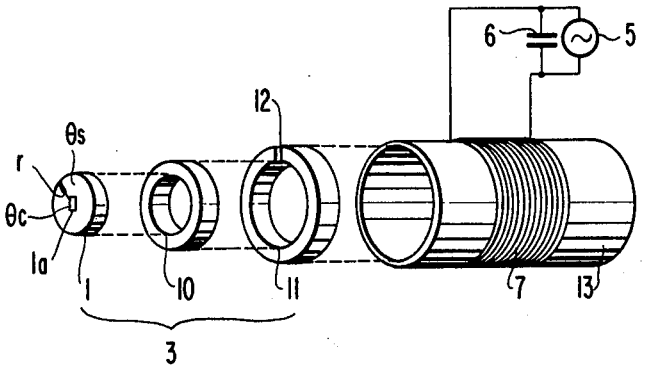
FIG 2
PRIOR ART
FIG 3
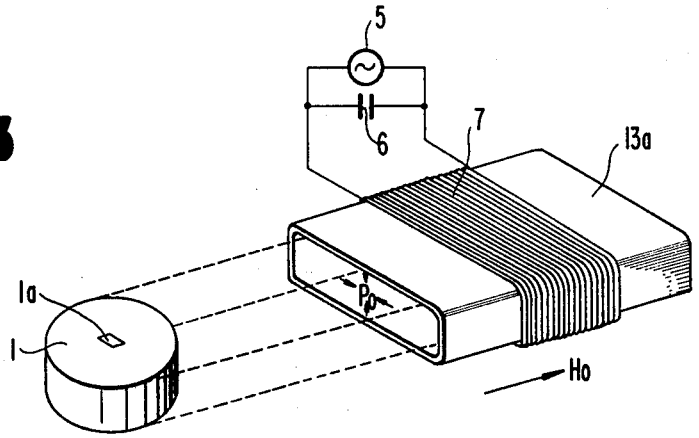

FIG 4
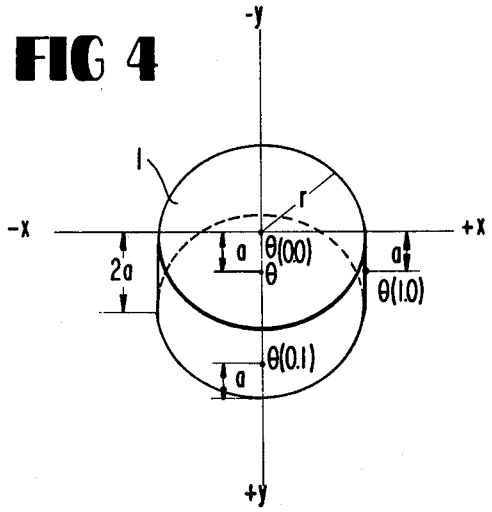
FIG 6
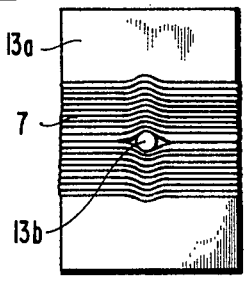
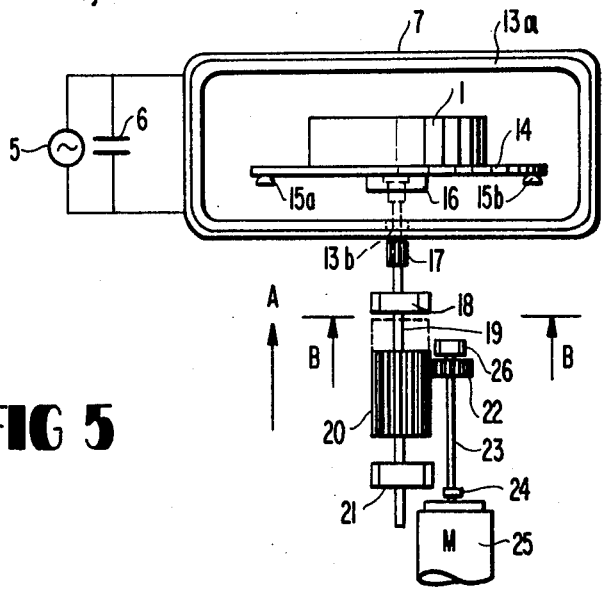
FIG 5
FIG 7
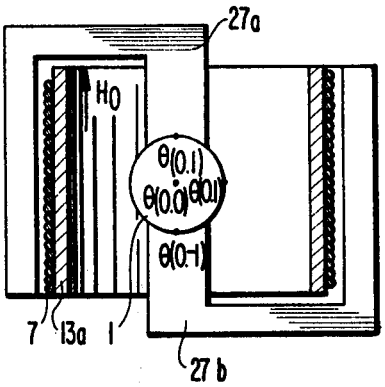

DEVICE AND METHOD FOR HEATING DIE

BACKGROUND OF THE INVENTION

1. Field of the Invention

This invention relates to a device and a method for preheating a die used in the hot extrusion of aluminum alloys and the like, and more particularly relates to a device and a method for rapidly heating such a die.

2. Description of the Prior Art

It is common in arts of extruding metals, such as aluminum alloys, into desired shapes, to heat a billet of an aluminum alloy to a very high temperature and to also preheat the die which defines the configuration of a resulting extrusion. However, when the die alone is preheated it becomes difficult and time consuming to handle the die and to attach it to an extruder. If too much handling time is required the die cools to room temperature.

To avoid such problem, there have been attempts and proposals to have the die built in an outer ring or sheath, so that the outer ring and die may be heated in an atomosphere-heat-treating furnace. In such preheating furnaces, it is a common practice to use a burning type heating furnace or a resistance-heating furnace for heating the die to a temperature from 450° C to 500° C.

However, because of the nature of an atomosphere-heating furnace, it takes three to five hours for the furnace to reach the desired temperature of 450° to 500° C and another 3 to 5 hours for the die to reach that temperature. For this reason, extra dies should be placed in the preheating furnace so they will be readily available if an unexpected need arises. Unfortunately, this shortens the service life of a die due to the vigorous oxidation thereof, with the result that many man hours must be spent for repairing dies. Furthermore, inasmuch as the furnace should be heated continuously to maintain it at the desired temperature, a great amount of electric power is used, thereby increasing operating costs.

There have been attempts to overcome the aforementioned disadvantages by using an induction-heating process to heat dies. One example of the aforesaid induction-heating type furnace is shown in FIG. 1, wherein a cylindrical die 1 having a nozzle in its center and an outer ring or sheath 2, to provide a die assembly 3, is placed on one end of a leg 4*a* of a fixed yoke, having a 'C' shape, while a coil 7 is wound around another leg 4*b* of the yoke and connected to an electric power source 5. A power-factor improving capacitor 6 is connected across the electric power source 5. A movable yoke 8 is secured by hinge means 9 to one end of the yoke 4, so that the die may be heated by a magnetic flux passing through the die 1. However, such an attempt requires a relatively long time for heating and poses a shortcoming of damaging the surface of the die 1 due to magnetic oscillation.

Another prior art heating device and method which overcomes the disadvantages of the previous method, is shown in FIG. 2. There, the die 1, having an extrusion nozzle 1*a*, is fitted in an intermediate insulating ring 10 which in turn is fitted in an outer ring 11 to provide a die assembly. The die assembly 3 is fitted in a bobbin or tube 13 in concentric relation thereto, while an induction-heating coil 7 is wound around the outer periphery of the bobbin 13. A power-factor improving capacitor 6 is connected across an electric power source 5, to which the aforesaid coil 7 is connected. Thus, magnetic flux is produced in the axial direction of the bobbin, thereby induction-heating the die.

The aforesaid device and method permits rapid heating of the die to a temperature of about 500° C within a duration as short as 10 minutes. In addition, the radiation of heat from the die 1 is prevented by means of the insulating intermediate ring 10. However, for reasons which will be explained below this method is only partially successful in achieving uniform temperature-distribution in heating the die.

More particularly, referring to FIG. 2, the maximum temperature difference between the center portion and outermost periphery of the die is given as follows:

$$\theta_s - \theta_{c\,max} = \frac{Po \cdot r}{2Kc} \cdot F\left(\frac{2r}{\delta}\right) \qquad (1),$$

wherein $r$: radius of die;

$\theta_s$o/c: temperature at the outermost periphery of die;

$\theta_c$o/o: temperature in the central portion of die;

$kc$: thermal conductivity depending on the type of material of die;

$po$: power density; and $F(2r/\delta)$: a function of the diameter $2r$ of the die and a permeable depth $\delta$ and is in the range of 0.6 to 0.9. The value $\delta$ is an electric constant depending on the type of material of the die and the frequency of the electric heating source.

As is clear from the aforesaid formula (1), the larger the diameter of the die, the greater will be a temperature difference $|\theta_s - \theta_c|$, with increased possibility of cracking in the die. For avoiding the above shortcoming, the power density P$o$ is limited to a lower value, or an input to the electric heating source is turned on and off repeatedly for uniformly heating the die, while the temperatures at the center and outermost periphery of the die are continuously measured. This leads to the result that the die is no longer rapidly heated. The measured values of the temperature distrubution of a die according to the aforesaid method and device were:

$$\theta_s = 550°\text{ C}, \theta_c = 250°\text{ C, and } |\theta_s - \theta_c|_{max} = 300°\text{ C},$$

for a case where the die diameter was 200 mm, the die thickness was 40 mm, the induction coil input was 78 kw, and the heating duration lasted for 5.3 minutes.

SUMMARY OF THE INVENTION

It is accordingly an object of the present invention to provide a device and a method for heating a die by avoiding the shortcomings of the prior devices and methods, i.e., the large temperature difference $|\theta_s - \theta_c|$.

It is another object of the present invention to provide a device and a method for heating a die rapidly.

It is a further object of the present invention to provide a device and a method for preheating a die, which device and method maintain the temperature difference between the central portion and peripheral portion of a die not more than 190° C by providing uniform magnetic-flux distribution in an induction-heating process.

It is a further object of the present invention to provide a device and a method for preheating a die, which device and method provide uniform temperature distribution by turning a die within a heating coil.

It is a further object of the present invention to provide a device and a method for preheating a die, which device and method provide uniform magnetic flux distribution by providing yokes for a die in an attempt to improve the distribution of magnetic flux.

It is a further object of the present invention to provide a device and a method for preheating a die, which device and method provide a flat induction-coil bobbin.

It is a further object of the present invention to provide a device and a method for preheating a die having magnetic flux penetrating in the diametrical direction of a die.

According to one aspect of the present invention, there is provided a device and a method, in which the direction of the center axis of a die is perpendicular to the direction of an alternating magnetic field produced by an induction-heating coil.

According to another aspect of the present invention, there is provided a device and a method for heating a die, in which the die is placed on a turn table for minimizing the temperature difference prevailing on the central portion and peripheral portion of the die.

According to a still another aspect of the present invention, there is provided a device and a method for heating a die, in which yokes are provided for the die for providing uniform magnetic flux distribution.

BRIEF DESCRIPTION OF THE DRAWINGS

FIG. 1 is a perspective view of the prior art induction-heating device;

FIG. 2 is a perspective view of another prior art induction-heating device;

FIG. 3 is a perspective view illustrative of the induction-heating device according to the present invention;

FIG. 4 is a perspective view of a die;

FIG. 5 is a front view illustrative of another induction-heating device according to the present invention;

FIG. 6 is a cross-sectional view taken along the line B—B of FIG. 5;

FIG. 7 is a partially cut away plan view of another induction-heating device according to the present invention.

DESCRIPTION OF THE PREFERRED EMBODIMENTS

FIG. 3 shows a preheating device and method according to the present invention. It should be noted that like parts are designated by like reference numerals throughout the various drawings. In the embodiment of FIG. 3, there is provided a bobbin 13*a* having a flat rectangular cross section, and a coil 7 is wound around the bobbin 13*a* and connected by way of a phase-advance capacitor 6 to an electric power source 5. The die 1 is placed within the flat bobbin 13*a* in a manner such that the center axis of the die is perpendicular to the longitudinal axis of the bobbin 13*a*.

When the electric power source 5 is turned on for effecting induction-heating, an alternating magnetic field H*o* is produced in the longitudinal axial direction of the bobbin 13*a*. The temperature difference in the induction heating device of FIG. 3 may be expressed according to the formula to be described below, as is clear from the discription in the article, "HEAT GENERATION AND TEMPERATURE DISTRIBUTIONS IN INDUCTION HEATED RECTANGULAR SECTION" by R. E. KOTHMANN and W. A. EMERSON, appearing in the 1971 IEEE Conference Record of the sixth annual meeting of the IEEE Industrial and General Application's Group.

The symbols used can be understood by referring to FIG. 4, wherein:

$\theta(0.0)$°/C: temperature in the center of die at a depth of where the thickness of the die is $2a$;

$\theta(1.0)$°/C: temperature of the position (1.0) of a die at a depth $a$, where the thickness of the die is $2a$;

$\theta(0.1)$°/C: temperature in the position (0.1) of a die at a depth $a$, where the thickness of the die is $2a$;

P*o*: surface power density of the die;

$2a$: thickness of the die; and

*kc*: thermal conductivity depending on the type of a material of the die.

The maximum temperature difference between the position $\theta(0.0)$ and $\theta(1.0)$ of the die is given as follows:

$$\{\theta(0.0) - \theta(1.0)\}\max = \frac{Po \cdot a}{kc}\{F(\frac{2a}{\delta}0.0) - F(\frac{2a}{\delta} - F(\frac{2a}{\delta}1.0)\} \quad (2),$$

wherein $$F(\frac{2a}{\delta}0.0) - F(\frac{2a}{\delta}1.0)$$

is a function of the thickness $2a$ of the die and the permeable depth $\delta$, and is generally no less than 0.5. The value $\delta$ depends on an electric constant of the type of a material used for the die and the frequency of an electric heating source.

Accordingly, the formula (2) may be expressed as follows:

$$\{\theta(0.0) - \theta(1.0)\}\max = \frac{Po \cdot a}{kc}0.5 \quad (3)$$

Comparing formula (1) with formula (2), it can be seen that where $r > a$, i.e. the radius of die is greater than the thickness of the die, and if the power density P*o* is constant, then $$|\theta_s - \theta|\max > |\theta(0.0) - \theta(1.0)|\max \quad (4)$$

This proves in principle that the heating device and method as shown in FIG. 3 is more advantageous than that of FIG. 2.

The following examples are illustrative of the features of the device and method according to the present invention, which is shown in FIG. 3.

EXAMPLE 1

In the case of the die shown in FIG. 4, the testing conditions were as follows: $2a=40$ mm, $2r=200$ mm, coil input=63 KW, heating duration=3.3 minutes. The test results were: $\theta(0.0)=560°$ C, $\theta(0.1)=370°$ C, $\theta(1.0)=560°$ C.

In other words, $$|\theta(0.0)-\theta(1.0)| = |560-560| = 0, \text{ and}$$
$$|\theta(0.0)-\theta(0.1)| = |560-370| = 190° \text{ C}$$

This reveals that the temperature distribution was improved over the prior art heating device and method shown in FIG. 2, and the temperature difference of 300° C is eliminated.

A study by the inventors of the test results reveals that the aforesaid improvements may be attributed to the fact that the range of the magnetic flux distribution within the bobbin 13*a* is narrowed at the end portion of the bobbin 13*a* in the axial direction thereof, presenting a smaller magnetic-flux-distribution factor in the position $\theta(0.1)$.

The arrangement shown in FIG. 5 contributes to equalizing the temperature difference between the center portion $\theta(0.0)$ and all end portions $\theta(1.0)$ and $\theta(0.1)$, thereby providing a uniform, but relatively small, temperature difference throughout the die.

Referring to FIG. 5, the flat bobbin 13*a* is provided with a through-hole 13*b* in the center of the bottom thereof, and the coil 7 is wound around the bobbin 13*a* in a manner to avoid the through-hole 13*b* as shown in FIG. 6. The coil 7 is connected by way of a phase-advance capacitor to the electric power source. Two guide rails 15*a*, 15*b* extend through the bobbin in the longitudinal direction but are secured in position apart from the walls of the bobbin in a manner not shown.

A die table 14 or a turn table, on which a die is to be placed, may slide on the guide rails 15*a*, 15*b*, and the table 14 is formed with a chuck means 16. An electric motor 25 is rigidly mounted on a support (not shown) and coupled by a coupling means 24 to a shaft 23. A spur gear 22 is secured on shaft 23 at one end thereof and meshes with an elongated axially slidable gear 20. A bearing 26 is loosely fitted on the shaft 23. The elongated gear 20 is secured on a shaft 19, which in turn is journaled in bearings 18, 19, but may slide in the axial direction. A coupling member 17 is secured to the tip portion of the shaft 19.

With the aforesaid arrangement, if the elongated gear 20 and shaft 19 are slidingly moved in the direction of arrow A, then coupling member 17 is fitted into chuck means 16 secured to the undersurface of the turn table 14, as shown by a broken line, so that the turn table 14 is lifted from the guide rails 15*a*, 15*b*. The rotation of the electric motor 25 is transmitted by way of spur gear 22 and elongated gear 20 to the turn table 14 to thereby rotate same at a reduced R.P.M. It is recommended that the die make 2 to 3 turns during the heating operation.

The test results of the embodiment shown in FIGS. 5 and 6 are as follows:

EXAMPLE 2

The test conditions were as follows: R.P.M. of the turn table = 0.25 r.p.m.. The diameter ($2r$) of the die shown in FIG. 4 = 200 mm, thickness ($2a$) = 40 mm, coil input = 56 KW, heating duration = 4.0 min.. The test results were $\theta(0.0)$ = 490° C, $\theta(0.1)$ = 450° C, $\theta(1.0)$ = 440° C. It is noted that the positions (0.1) and (1.0) represent the starting positions of the rotating die.

In other words, $|\theta(0.0)-\theta(1.0)| = |490-450| = 40°$ C, and $|\theta(0.0)-\theta(0.1)| = |490-440| = 50°$ C.

The above test results show that the temperature difference throughout a die may be greatly minimized, while allowing rapid and efficient heating of the die.

FIG. 7 shows still another embodiment of the invention wherein a uniform magnetic flux distribution is provided while maintaining the die stationary. More specifically, U-shaped yokes 27*a* and 27*b* are provided for a die in the direction of (0.1) (0. − 1), thereby increasing the magnetic flux density at the positions $\theta(0.1)$, $\theta(0.-1)$ to provide a more uniform magnetic-flux distribution. After heating the die yokes 27*a*, 27*b* may be removed from the bobbin 13*a*. The yokes used herein should be made of permalloy, silicon steel plate or the like which provide high magnetic permeability.

The embodiment of FIG. 7 increased the uniformity of the temperature distribution for the die under the conditions of Example 2, and provided a ratio of $\theta(0.0) : \theta(0.1)$ = 100 : 78.

As is apparent from the foregoing description, the device and method according to the present invention may rapidly heat a die without a large temperature difference and cracking.

What is claimed is:

1. Apparatus for rapid and uniform pre-heating of a die used for hot extrusion of aluminum alloys, said die having a cylindrical shape with a flat surface and a radial surface, which has a radius which is greater than its thickness and having its extrusion axis along the longitudinal center of said cylinder, comprising:

a hollow rectangular bobbin having a longitudinal axis, wherein the short side of said rectangular bobbin is less than the diameter of said die and the long side is greater than the diameter of said die;

an induction coil wound upon said bobbin around said longitudinal axis and upon the sides of said rectangular bobbin;

a source of power connected to said induction coil for producing a magnetic flux field which is parallel to the longitudinal axis of said bobbin;

whereby said die can only be placed in said bobbin with the flat surface of said die parallel to the long side of said bobbin; and whereby said extrusion axis is perpendicular to the longitudinal axis of said coil and perpendicular to said flux field.

2. The apparatus of claim 1 further comprising means for rotating said die about its axis while within said bobbin.

3. The apparatus of claim 2 wherein said means for rotating comprises, a free rotatable die support, a pair of support means within said bobbin for supporting said die support means, rotating shaft engaging means adapted to pass through an opening in the wall of said bobbin to rotatably interlock with said die support and lift said die support off said pair of support means, and means for rotating said shaft engaging means.

4. The apparatus of claim 1 further comprising high magnetic permeability yoke means positioned at least partially within said bobbin and adjacent the edges of said die nearest the bobbin openings to increase the magnetic flux at said edges.

5. A method of uniform pre-heating of a die which is used for hot extrusion of aluminum alloys, said die having a cylindrical shape with a flat surface and a radial surface, which has a radius which is greater than its thickness and has an extrusion axis along the longitudinal center of said cylinder, comprising the steps of:

winding an induction heating coil around the longitudinal axis of a rectangular bobbin and upon the sides of said rectangular bobbin, wherein the short side of said rectangular bobbin is less than the diameter of said die and the long side is greater than the diameter of said die;

applying a source of A.C. power to said induction heating coil for producing a magnetic flux which is parallel to the longitudinal axis of said bobbin;

placing said die in said bobbin such that said die extrusion axis is perpendicular to the longitudinal axis of said bobbin and between the ends of said bobbin.

6. The method of claim 5 further comprising rotating said die during the time said a.c. magnetic field is being applied.

7. The method of claim 6 wherein said magnetic field is applied for a duration of four minutes or less, and said die is rotated between one and three revolutions.

8. The method of claim 5 further comprising the step of placing high magnetic permeability yokes adjacent the edges of said die nearest the open ends of said bobbin.

* * * * *